US005815843A

United States Patent [19]

Brillhart, III et al.

[11] Patent Number: 5,815,843

[45] Date of Patent: Oct. 6, 1998

[54] ACCESSORY FASTENER FOR GARMENTS

[75] Inventors: Lee W. Brillhart, III, Seattle; Ricky W. Stewart, Mukilteo, both of Wash.

[73] Assignee: Survival, Inc., Seattle, Wash.

[21] Appl. No.: 670,402

[22] Filed: Jun. 25, 1996

[51] Int. Cl.[6] ..... A41D 27/20; A45C 3/00; A45C 13/00; A44C 5/14

[52] U.S. Cl. ..... 2/247; 24/589; 150/111; 150/113; 190/102; 190/108; 190/110

[58] Field of Search ..... 2/247, 249, 94, 2/319; 24/589, 702, 587, 669, 665, 664, 585; 190/119, 102, 108, 110; 150/111, 113; 383/69; 292/DIG. 39, DIG. 40

[56] References Cited

U.S. PATENT DOCUMENTS

| | | | |
|---|---|---|---|
| 813,838 | 2/1906 | Steinberg | 24/665 |
| 1,113,878 | 10/1914 | Conde et al. | 24/665 |
| 1,151,333 | 8/1915 | Baruch | 24/585 X |
| 1,255,481 | 2/1918 | Spranger | 2/247 |
| 1,654,163 | 12/1927 | Evans | 292/DIG. 39 X |
| 4,428,098 | 1/1984 | Coker et al. | 383/69 X |
| 4,673,070 | 6/1987 | Ambal . | |
| 4,922,586 | 5/1990 | Robson | 24/589 X |
| 5,410,784 | 5/1995 | Katz | 24/589 |
| 5,465,425 | 11/1995 | Crispin | 2/247 X |
| 5,471,684 | 12/1995 | Casale | 24/587 X |

FOREIGN PATENT DOCUMENTS

| | | | |
|---|---|---|---|
| 3801192 | 7/1989 | Germany | 383/69 |

*Primary Examiner*—C. D. Crowder
*Assistant Examiner*—Shirra L. Jenkins
*Attorney, Agent, or Firm*—Richardson & Folise

[57] ABSTRACT

A fastener for removably attaching pockets and other accessories to garments which includes slidably interlocking male and female members. The male member also includes a locking tab which cooperates with a locking post on the female member for securing the fastener in a closed position. The male member and the female member may be attached to the pocket and the garment respectively by sewing them in position.

10 Claims, 5 Drawing Sheets

ACCESSORY FASTENER FOR GARMENTS

BACKGROUND OF THE INVENTION

This invention relates generally to fasteners and more particularly to a fastener for removably attaching pockets or other accessories to a utility vest or other garments.

People engaged in outdoor activities have long used garments customized for particular activities. In addition to environmental considerations the design of such garments is often influenced by the nature and number of items which are desirable to carry during such activities. One style of garment which is a perennial favorite among hunters, fisherman and hikers is the vest. For example, hunters of upland game birds might choose a vest which includes pockets or elasticized cartridge belt strips convenient for carrying shotgun shells and a large lined pocket for carrying downed birds. Fishermen on the other hand might choose a vest having pockets adapted for carrying fishing accessories such as flies, leaders and sinkers and an attached sheath for a knife. Other activities such as hiking and cross-country skiing each have their own unique accessory and garment design requirements.

In constructing specialty vests and other similar garments, customized pockets, accessory holders, fittings and other connectors are typically attached to the garment fabric permanently by sewing. As a result, it is difficult to adapt a vest specialized for one activity to another, thus requiring users to purchase a number of vests each specialized for a particular activity. Moreover, within a given activity the items to be carried, and therefore the most desirable vest configuration, may vary depending on the season or details of the activity.

A desirable solution to this problem is to provide for a utility vest having means to removably attach pockets of various sizes and other accessories. It is well known to attach items to garments using buttons or conventional snap fasteners but the difficulty with such fasteners is that they are relatively easy to accidentally disengage, which may result in loss of the fastened item or spillage of its contents. It is also known to use zippers for such purposes, and while they are more secure they tend to be more difficult to engage and disengage.

Accordingly it is an object of this invention to provide a fastener for attaching pockets and other accessories to a garment which is relatively secure and easy to operate even under difficult conditions.

It is another object of this invention to provide for such a fastener which is relatively inexpensive to manufacture and attachable to garments and accessories by conventional sewing techniques.

SUMMARY OF THE INVENTION

This invention can be broadly summarized as providing for an accessory fastener for garments such as a utility vest. The fastener includes a male member having a base and an elongated rail; it also includes a female member having a base and a receiver portion which is slidably interlockable with the rail.

The invention can also be broadly summarized as providing for a utility vest which includes a vest body, one or more pockets and one or more such fasteners secured to the vest body and the pockets for removably attaching the pockets.

In accordance with a more detailed aspect of the invention, the fastener also includes a locking post and a locking tab for removably securing the male member in a predetermined position of locking engagement with respect to the female member.

In accordance with a yet more detailed aspect of the invention, in the preferred embodiment at least a portion of the rail in cross section is t-shaped. In other embodiments that cross sectional shape be elliptical or circular, and in yet another embodiment the male member in cross section is a mirror image of the female member.

DETAILED DESCRIPTION OF THE PREFERRED EMBODIMENTS

The novel features believed to be characteristic of this invention are set forth in the appended claims. The invention itself, however, may be best understood and its various objects and advantages best appreciated by reference to the detailed description below in connection with the accompanying drawings.

Figure 1:
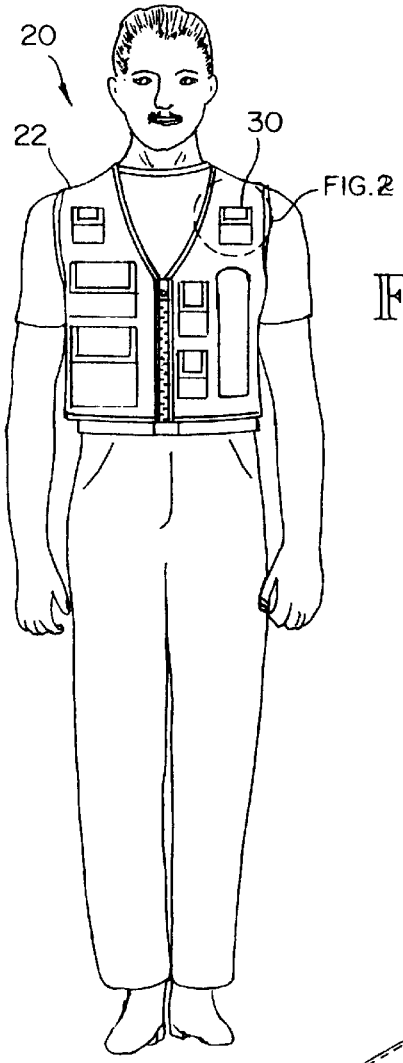
FIG. 1 is an illustration of a utility vest worn by a typical user and having a number of pockets of various sizes removably attached to it with the subject invention.
Figure 2:
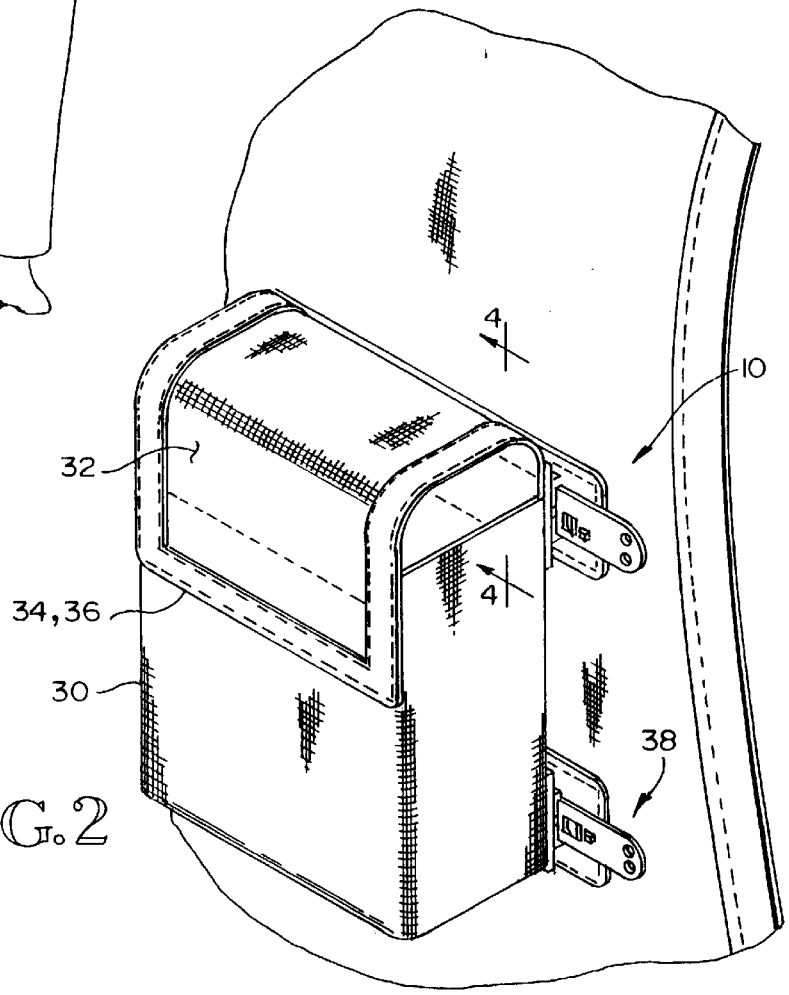
FIG. 2 is a perspective view illustrating a portion of the vest of FIG. 1 in the subject invention.

FIGS. 1 through 6 illustrate the preferred embodiment of a fastener constructed in accordance with the teachings of the present invention and generally designated by the number 10. FIG. 1 illustrates a utility vest 20 worn by a typical user and including a vest body 22 and a number of pockets of various sizes, of which pocket 30 is typical. Both the vest body and the pockets are made of a suitable fabric, and each of those pockets is removably attached to the vest body by such a fastener (not shown). Referring to FIG. 2 it can be seen that pocket 30 is of conventional design and includes flap 32 which is held in a closed position by hook and loop fastener strips such as strips 34 and 36 as is well known. The pocket is secured to vest body 22 by upper fastener 10 and lower fastener 38 which is identical to fastener 10.

Figure 3:
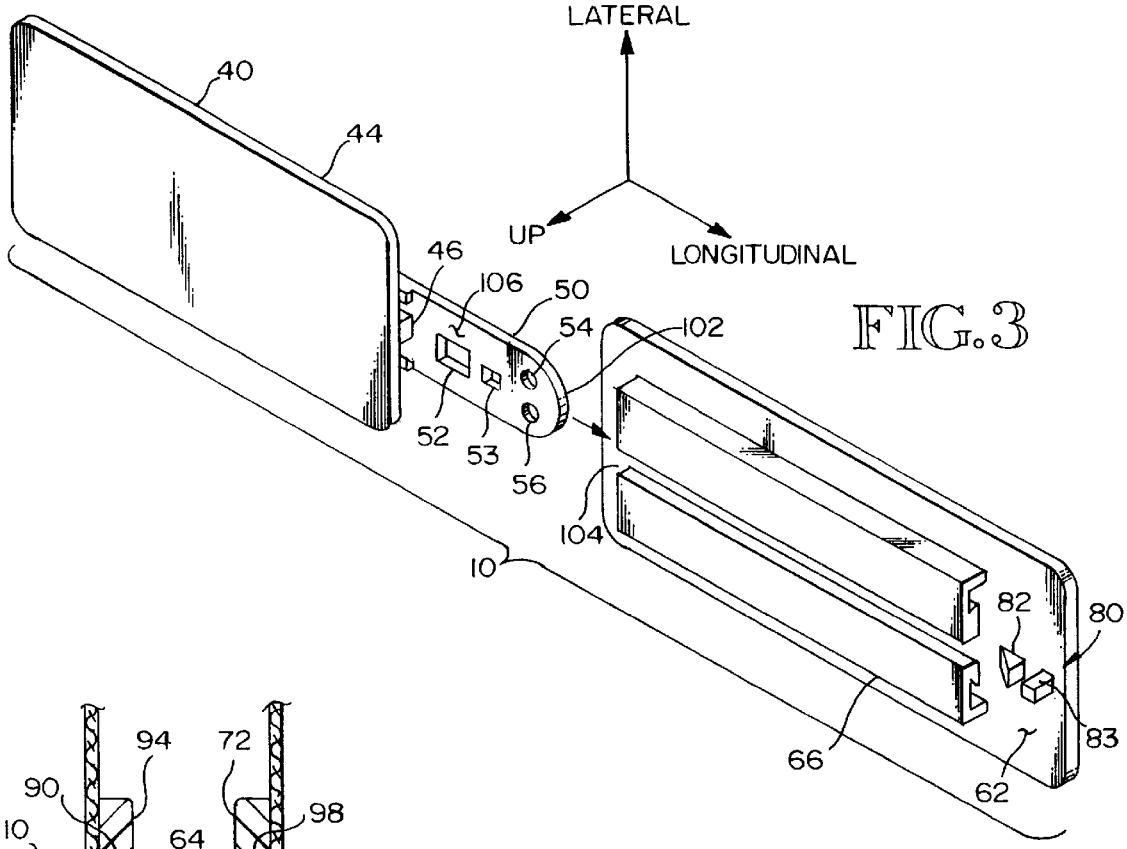
FIG. 3 is an exploded perspective view of the subject invention.
Figure 4:
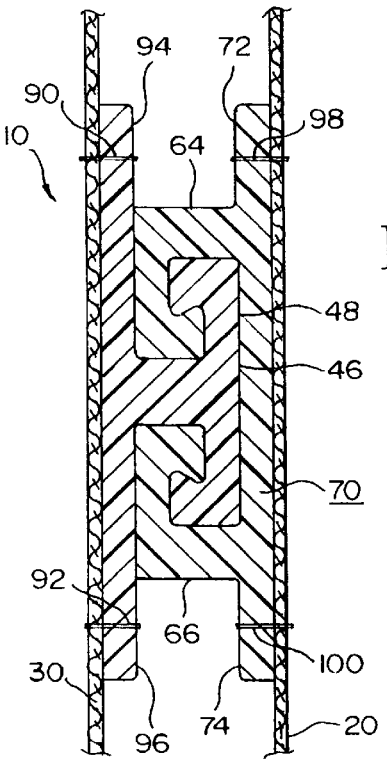
FIG. 4 is a cross section taken at 4—4 of FIG. 2.

Referring to FIG. 3 it can be seen that fastener 10 includes male member 40 and female member 42, both of which are preferably formed from medium density polyethylene although other suitable elastomers may be substituted. As shown in FIGS. 3 and 4 member 40 includes flat rectangular base 44 and t-shaped rail 46 which extends the entire length of base 44. The T-shaped rail includes a serif intersecting the top portion at an acute angle. Cap 48 of rail 46 extends beyond base 44 to form locking tab 50. Slots 52 and 53 and holes 54 and 56 extend through the locking tab as shown.

Female member 42 includes base 60 having first and second opposing ends, which is substantially identical in size and shape to base 44 of the male member. Formed on one side 62 of base 60 is a pair of spaced parallel oriented angle members 64 and 66 which cooperate with base 42 to form channel shaped receiver portion 70 as shown in FIG. 4. Flanges 72 and 74 of base 42 extend laterally beyond angles 64 and 66 respectively. Also formed on side 62 of the base is locking post 80 which is shown in greater detail in FIG. 6. Ramp 82 of the locking post faces generally toward angle members 64 and 66. Ribs 84 and 86 are formed in opposing sides of the locking post and are oriented parallel to surface 62.

As can be seen in FIG. 4, the contours of adjoining portions of rail 46 and receiver portion 70 conform in cross section so as to create an interlockable pair. Clearance between the two is provided only as necessary to permit a longitudinal sliding fit between the members.

Fastener 10 is prepared for use by first determining the desired position of pocket 30 on vest 20. Next, male member 40 and female member 42 are affixed to pocket 30 and vest 20 respectively so that when the fastener is closed as shown in FIG. 2 the pocket will be in the desired position on the vest. Preferably male member 40 is sewn to the pocket along seams 90 and 92 which pass through pocket 30 and through flanges 94 and 96 respectively of base 44. Similarly flanges 72 and 74 of base 42 are sewn to vest 20 along seams 98 and 100 respectively.

In order to install pocket 30 on the vest, leading edge 102 of locking tab 50 is first inserted in end 104 of receiver portion 70 and pushed through the channel until it engages ramp 82 of locking post 80. The purpose of the locking tab is to facilitate engagement of the male and female members of the fastener and to properly align the two members as the fastener is closed. As the male member is forced into further engagement with the female member the locking tab will be forced to deflect upward from surface 62 and ride up ramp 82 of the locking post. As the male member is advanced further ramp 82 and post 83 will enter slots 52 and 53, respectively. At that point closure of the fastener is completed by pressing downward on surface 106 of the locking tab sufficiently to force it over ribs 86 and 84 of the post, thus securing the fastener in the closed position. To remove the pocket, the user merely needs to raise the locking tab up sufficiently to clear the locking post and then slide the male member longitudinally out of engagement with the female member.

Figure 5:
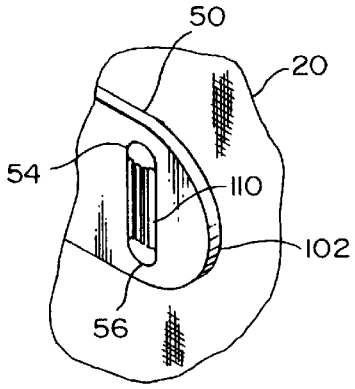
FIG. 5 is a perspective view of a portion of the fastener of FIG. 3.
Figure 6:
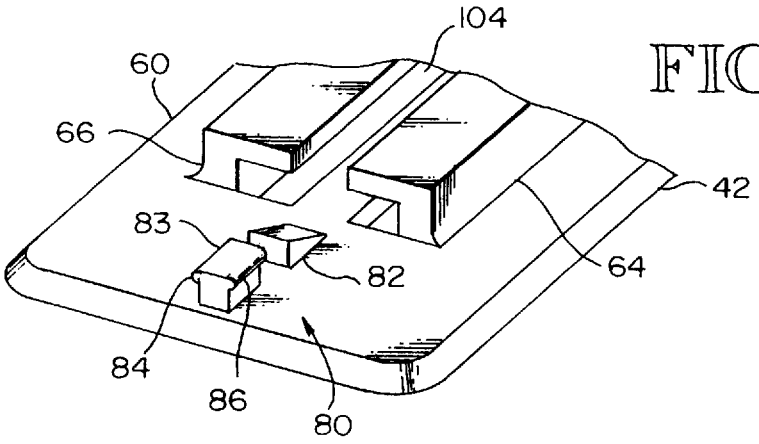
FIG. 6 is a perspective view of another portion of the fastener of FIG. 3.

In some circumstances it may be desirable to permanently secure the fastener in the closed position. This can be done easily by looping thread 110 a number of times through opening 54, vest 20 and opening 56 as shown in FIG. 5 after it has been secured at a locking post.

Figure 7:
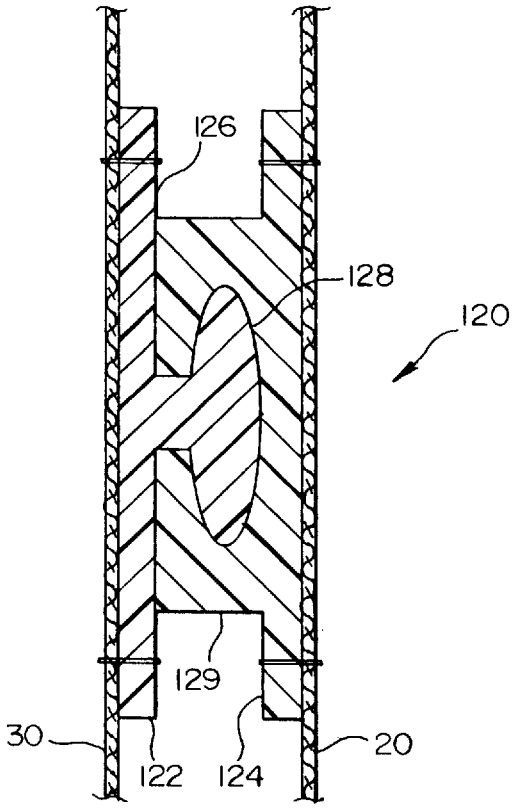
FIGS. 7 through 9 are cross sectional views of second, third and fourth embodiments, respectively, of the subject invention.
Figure 8:
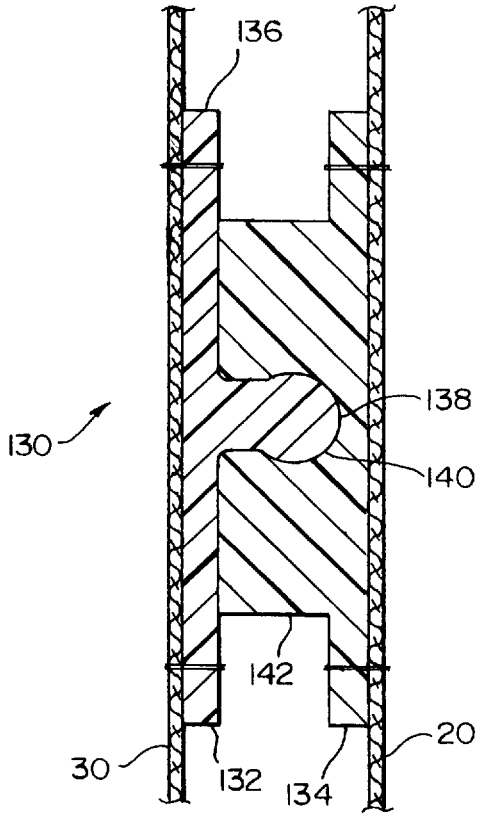
Figure 9:
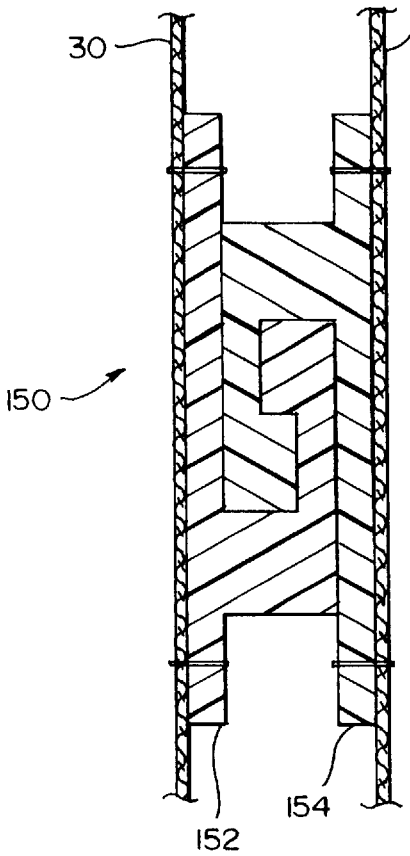

FIGS. 7 through 9 illustrate second, third and fourth embodiments of the present invention in which the cross sectional configurations of the interlocking male and female members of the fastener have been modified. In FIG. 7 the fastener, generally designated by the number 120, includes male member 122 and female member 124. In this embodiment the male member includes the base 126 which is similar in shape to base 44 and centrally located rail 128 the upper portion of which is elliptical in cross section. Female member 124 includes receiver portion 129 which is shaped so as to interlockingly engage rail 128. Fastener 130, illustrated in FIG. 8, includes male member 132 and female member 134. Male member 132 includes base 136 and longitudinally oriented rail 138, the upper portion 140 of which is circular in cross section. Likewise, female member 134 includes interlocking receiver portion 142. In fasteners 120 and 130, as in the preferred embodiment of FIG. 4, the receiver portion is contoured so as to interlockingly engage the rail and sufficient clearance is provided between the two so as to permit a longitudinally sliding fit. Fastener 150, illustrated in FIG. 9, differs from the other embodiments in that male member 152 in cross section is a mirror image of female member 154. One advantage of this embodiment, of course, is that the male and female members are interchangeable. As with the other embodiments they are contoured so as to be interlockingly engagable and to permit a longitudinally sliding fit between the two. As in the preferred embodiment, the male and female portions of fasteners 120, 130 and 150 are preferably sewn to the pocket and the vest.

Figure 10:
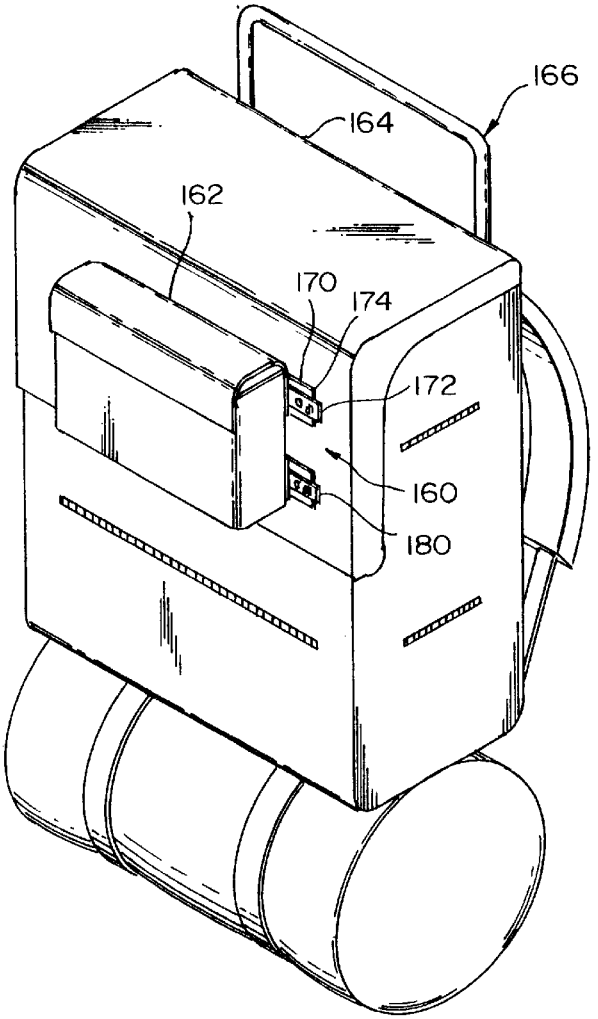
FIGS. 10 and 11 are perspective views of the fifth and sixth embodiments respectively of the subject invention.

It should be apparent that the present invention has many applications in addition to those described above. For example, FIG. 10 illustrates a fifth embodiment generally designated by the number 160 in which the invention is used to removably secure accessory packet 162 to pack 164 of a backpack assembly generally designated by the number 166. Upper fastener 170 includes male member 172 and female member 174 which are sewn to accessory packet 162 and pack 164, respectively. Details of the construction and operation of upper fastener 170 are otherwise very similar to those of fastener 10 of the preferred embodiment described above and lower fastener 180 is identical to upper fastener 170.

Figure 11:
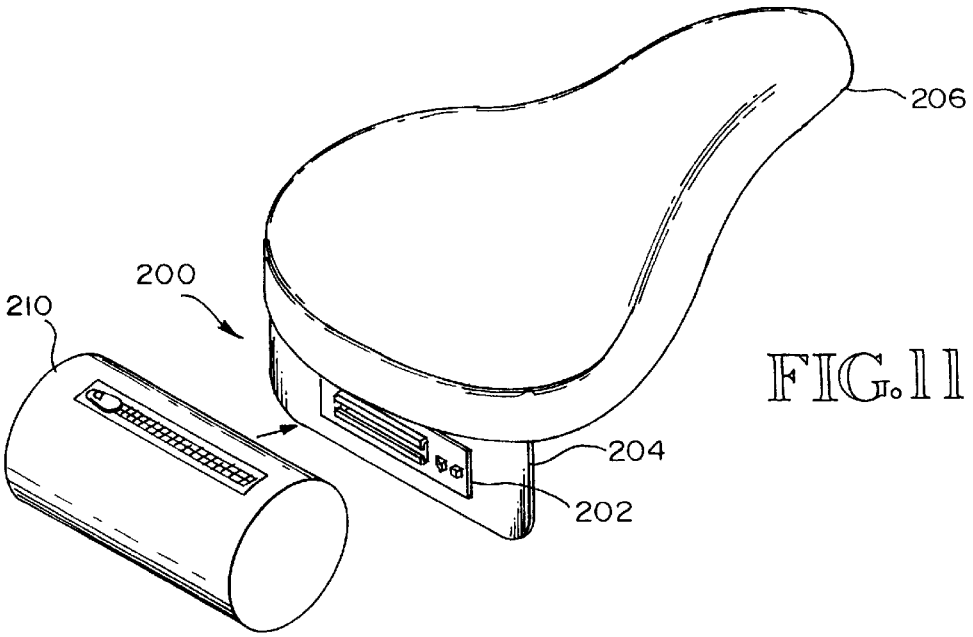

FIG. 11 illustrates yet another application of the subject invention in which it is used to removably attach an under-the-seat bicycle accessory pouch beneath a bicycle seat. In that figure, the fastener generally designated by the number 200 includes female member 202 which is mounted to support bracket 204 which in turn is attached beneath a typical bicycle seat 206. Male member 208 (not shown) is sewn to pouch 210. Other details of the construction and operation of fastener 200 are also very similar to fastener 10 of the preferred embodiment described above.

Thus it can be seen that the present invention provides for an improved fastener for garments which incorporates many novel features and offers significant advantages over the prior art. Although only six embodiments of this invention have been illustrated and described, it is to be understood that obvious modifications can be made of it without departing from the true scope and spirit of the invention.

I claim:

1. A fastener comprising:

a male member having a first base and an elongated rail;

a female member having a second base and a receiver portion slidably interlockable with the rail; and, means for removably securing the male member in a predetermined position of interlocking engagement with respect to the female member, the means for securing including a locking post and a ramp attached to the second base the ramp being longitudinally spaced from the post, and a locking tab extending from the rail, insertable in the receiver portion and connectable to the locking post, the locking tab including first and second slots through which the locking post and ramp respectively, may extend.

2. The fastener of claim 1 wherein the locking post includes a rib for retaining the locking tab on the locking post.

3. The fastener of claim 1 wherein at least a portion of the rail in cross section is T-shaped.

4. The fastener of claim 1 wherein at least a portion of the rail in cross section is elliptical.

5. The fastener of claim 1 wherein at least a portion of the rail in cross section is circular.

6. The fastener of claim 1 wherein at least one of the first and second bases is attachable to a fabric by sewing.

7. The fastener of claim 1 wherein at least one of the first and second bases is formed from an elastomer.

8. A fastener comprising;

a male member having a first base and an elongated rail, at least a portion which in cross section is shaped in the form of the letter T including a top portion and a serif intersecting the top portion at an acute angle;

a female member having a second base and a receiver portion slidably interlockable with the rail; and, a locking post and a ramp attached to one of the bases, the ramp being longitudinally spaced from the post, and a locking tab extending from the rail, insertable in the receiver portion and connectable to the locking post, the locking tab including first and second slots through which the locking post and ramp respectively, may extend.

9. A utility vest comprising;

a vest body;

a pocket; and, a fastener secured to the vest body and to the pocket for removably attaching the pocket to the vest body, the fastener including a male member having a first base and an elongated rail, a female member having a second base and a receiver portion slidably interlockable with the rail, and means for removably securing the male member in a predetermined position of interlocking engagement with respect to the female member, the means for securing including a locking post and a ramp attached to one of the bases, the ramp being longitudinally spaced from the post, and a locking tab extending from the rail, insertable in the receiver portion and connectable to the locking post, the locking tab including first and second slots through which the locking post and ramp respectively, may extend.

10. A fastener comprising:

a male member having a first base and an elongated rail;

a female member having a second base and a receiver portion slidably interlockable with the rail and having first and second opposing ends; and, means for removably securing the male member in a predetermined position of interlocking engagement with respect to the female member, the means for securing including a locking post attached to the second base and longitudinally spaced from the first end of the receiver portion and a locking tab extending from the rail, longitudinally insertable in the second end of the receiver portion and connectable to the locking post, the locking tab including an opening into which the locking post may extend.

* * * * *